United States Patent [19]

Teach

[11] 4,028,822

[45] June 14, 1977

[54] MANUALLY OPERABLE DEPTH CONTROL FOR TRENCHERS

[75] Inventor: Ted L. Teach, Dayton, Ohio

[73] Assignee: Laserplane Corporation, Dayton, Ohio

[22] Filed: Apr. 20, 1976

[21] Appl. No.: 678,694

[52] U.S. Cl. ..... 37/86; 37/DIG. 19; 37/80 R; 37/191 R; 33/185 V

[51] Int. Cl.[2] ..... E02F 5/06; B27G 23/00

[58] Field of Search ..... 37/191 R, 80 R, 83, 37/86–90, DIG. 1, DIG. 19, DIG. 20, 192 R, 192 A; 172/4.5; 33/85, 102, 103, 185 R, 185 V

[56] References Cited

UNITED STATES PATENTS

| | | | |
|---|---|---|---|
| 289,734 | 12/1883 | Welch | 37/DIG. 19 |
| 1,131,114 | 3/1915 | Bunnell | 37/DIG. 19 |
| 1,237,260 | 8/1917 | Bentson | 37/DIG. 19 |
| 1,300,371 | 4/1919 | French | 37/DIG. 19 |
| 1,395,810 | 11/1921 | George | 37/DIG. 19 |
| 1,661,812 | 3/1928 | Smith | 37/DIG. 19 |
| 2,464,003 | 3/1949 | Stadler | 37/DIG. 19 |
| 2,508,087 | 5/1950 | Bailey | 37/DIG. 19 |
| 2,580,954 | 1/1952 | Przybylski | 33/185 V |
| 3,044,194 | 7/1962 | Balkheimer | 37/86 |
| 3,462,845 | 8/1969 | Matthews | 37/DIG. 19 |

FOREIGN PATENTS OR APPLICATIONS

| | | | |
|---|---|---|---|
| 1,912,614 | 10/1970 | Germany | 37/DIG. 19 |
| 1,049,793 | 11/1956 | Germany | 37/80 R |
| 285,323 | 2/1965 | Netherlands | 37/DIG. 20 |
| 88,102 | 8/1956 | Norway | 37/83 |

*Primary Examiner*—E. H. Eickholt

[57] ABSTRACT

The invention relates to a mechanism permitting the manual control of an trencher which is normally carried in trailing relationship to a vehicle and is pivotally mounted to the vehicle. The effective cutting depth of this type trencher is determined by the angle of the frame carrying the endless chain relative to the horizontal. An upstanding sighting bar is pivotally mounted to the frame of the trencher and means are provided for maintaining the sighting bar in a true vertical position irrespective of the angle of the frame relative to the horizontal. Additionally, the effective vertical height of the sighting bar is varied as a trigonometric function of the angle of the digging frame relative to the horizontal.

5 Claims, 3 Drawing Figures

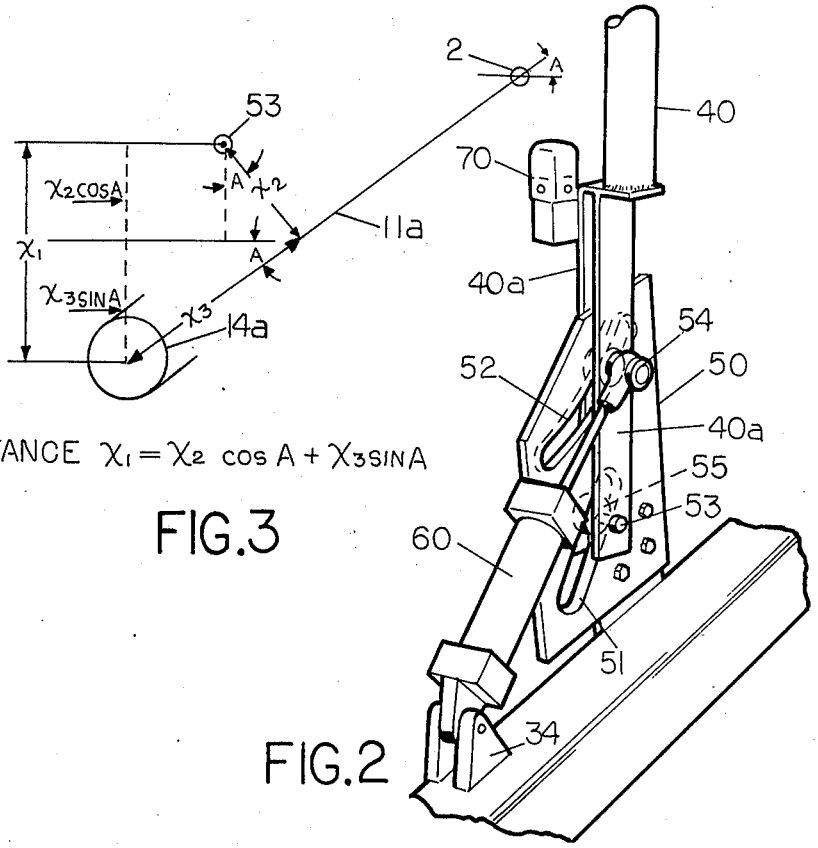
DISTANCE $X_1 = X_2 \cos A + X_3 \sin A$
FIG.3
FIG.2
FIG.1
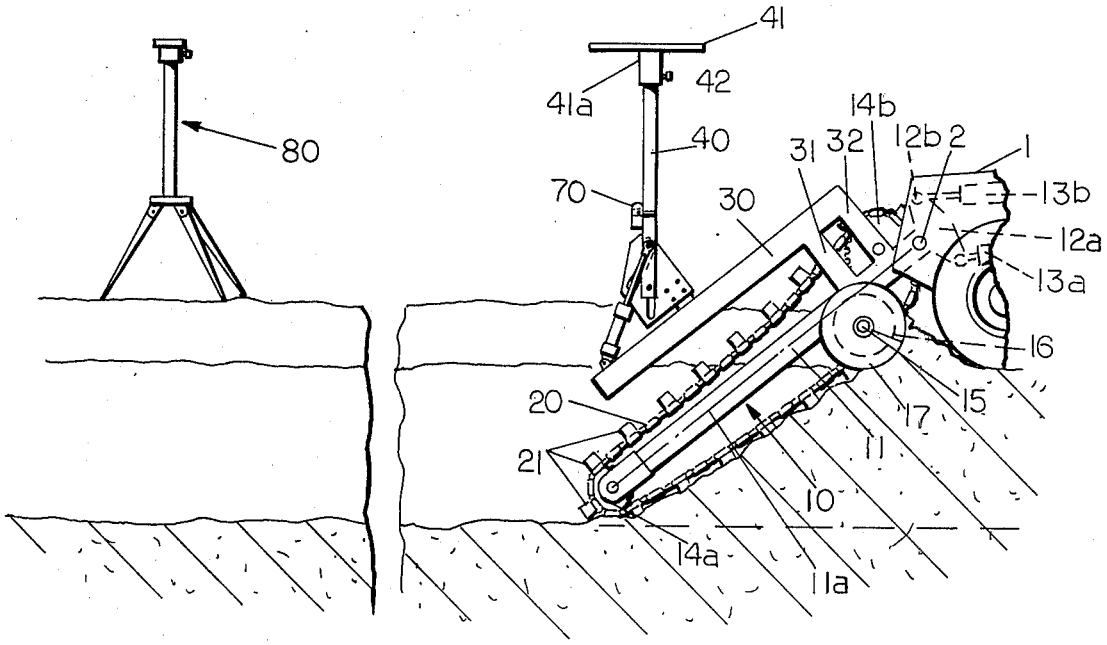

MANUALLY OPERABLE DEPTH CONTROL FOR TRENCHERS

BACKGROUND OF THE INVENTION

A variety of endless chain type trenchers have heretofore been utilized. Normally, such trenchers comprise an elongated frame having one end thereof pivotally mounted on a vehicle for movement in a vertical plane parallel to the path of travel of the vehicle. The digging frame provides a mounting for a power-driven endless chain carrying a plurality of spaced digging scoops. Thus the depth of the trench to be dug is determined by the angular position of the digging frame with respect to the horizontal, hereinafter called the digging frame angle. Such angular position can be determined by hydraulic cylinders appropriately connected between the digging frame and the vehicle. If the vehicle is moving over perfectly level ground, sighting bars can be located along the path of the trench to be dug and a sighting bar provided on the digging frame adjacent to the operator's position so that whenever the operator's sighting bar departs from the reference plane defined by the stationary sighting bars, the operator may operate the hydraulic cylinders to change the angular position of the digging frame and thus re-establish the effective depth of the trench at the desired level; however, few if any trenching jobs involve perfectly level terrain and most prime mover vehicles which are employed to mount endless chain type diggers have relatively short coupled wheels. Thus, any obstructions or depressions in the terrain traversed by the vehicle will result in pitching movement of the vehicle which result in variations in the angular position of the digging frame, hence in the effective depth of the trench being dug. There is the further complication that the upstanding mast upon which the operator's sighting bar is mounted will not normally move vertically exactly the same amount as the variation in the depth of the trench. This is due to the fact that the trenching frame is pivotally mounted to the vehicle and any upward or downward movement of such frame results in a tilting movement of any upstanding mast relative to the true vertical, hence introducing a distortion and inaccuracy when such sighting bar is employed as the sole means for maintaining the depth of the trench at the desired level beneath a reference plane determined by a plurality of stationary sighting bars disposed along the path of the trench being dug.

In my co-pending application Ser. No. 628,095 filed Nov. 3, 1975, of which this application constitutes a continuation in part, it has been proposed to automatically control the digging depth of an endless chain type trencher by establishing a reference plane over the working area in the form of a rotating laser beam and then providing sensors carried by an upstanding vertical mast mounted on the digging frame to detect any departures of the desired depth of the trench relative to the reference plane and effect the necessary correction in the digging angle of the trencher. This equipment, while very effective, is necessarily expensive and the operator who does not have a large volume of trenching jobs may well prefer to utilize manual control of the digging depth of the trencher if he can be assured that reasonable accuracy is obtainable.

OBJECTS OF THE INVENTION

Accordingly, it is an object of this invention to provide an improved mechanism for manually controlling the depth of a trench produced by an endless chain type, pivotally mounted trencher. In particular, it is an object of this invention to provide a manually operable trench depth control system which permits an operator to accurately control trench depth by maintaining a sighting bar adjacent to the operator's position on the trencher in constant alignment with stationary sighting bars positioned along the path of the trencher.

A specific object of the invention is to provide a trench depth indicating mast for an endless chain type trencher mounted on a frame which is pivotally secured to a vehicle in trailing relationship thereto wherein the upstanding mast is automatically maintained in a true vertical position irrespective of the digging angle of the trencher frame relative to the horizontal and, concurrently, the effective height of the mast is modified as a trigonometric function of the angle of the digging frame relative to the horizontal to provide an accurate indication of the exact depth of the trench being dug.

Other objects and advantages of the invention will become apparent to those skilled in the art from the following detailed description taken in conjunction with the annexed sheets of drawings.

DESCRIPTION OF DRAWINGS

FIG. 1 is a side elevational, schematic view of a trencher embodying this invention.

FIG. 2 is a partial perspective view of the mast position control mechanism of FIG. 1.

FIG. 3 is a schematic view of a trencher of FIG. 1 illustrating the geometric relationship of the trencher and the bottom of the sighting mast.

DESCRIPTION OF INVENTION

In FIG. 1 there is schematically shown a tractor-type vehicle 1 having means thereon for pivotally mounting an endless chain type trencher 10 at the rear end of the tractor. Trencher 10 comprises a digging frame 11 having the forward end thereof secured to a pivot shaft 2 carried by the vehicle 1. A pair of crank arms **12*a* and 12*b* are respectively rigidly secured to actuating cylinders 13*a* and 13*b* which in turn are respectively pivotally mounted (not shown) on vehicle 1. Thus the digging frame 11 may be shifted in a vertical plane about the pivotal mounting shaft 2 from an inoperative position wherein the digging frame 11 is completely above the ground, to a digging position where the rear end of digging frame 11** is disposed below the ground level.

Suitable chain sprockets **14*a* and 14*b* are provided at each end of the digging frame 11 and are driven by power means (not shown) on vehicle 1. The sprockets 14*a* and 14*b* in turn drive an encircling digging chain 20 carrying digging scoops 21. At an intermediate point on the frame 11, a horizontal shaft 15 is provided which mounts an idler sprocket 16 driven from the endless chain 20. On both sides of shaft 15, a helical diverter 17 is mounted which moves the dirt carried upwardly by the digging scoops 21 on the endless chain 20** to a position on each side of the resulting trench.

All of the mechanism heretofore described is conventional and, for this reson, is shown only in schematic fashion.

In accordance with this invention, a sub-frame 30 is provided having inverted V-shaped mounting brackets 31 and 32 rigidly secured to the top portions of digging frame 11 and straddling the chain 20. Sub-frame 30 projects downwardly and rearwardly, generally parallel to the line 11*a* drawn between the rotational axis of the rear chain sprocket 14*a* and the axis of the frame pivot shaft 2, which line will hereinafter be referred to as the digging frame axis. At a point on the rear end of the sub-frame 30, an upstanding plate 50 is provided and this plate provides a mounting for two spaced, depending legs 40*a* of an upstanding mast 40, on the top of which a sighting bar 41 is slidably mounted by a surrounding tube portion 41*a* and a clamping bolt 42.

The plate 50 is provided with two vertically spaced cam slots 51 and 52. The specific configuration of these cam slots will be later described. The legs 40*a* of mast 40 are mounted in straddling relationship and secured to plate 50 by transversely projecting pins 53 and 54 bearing cam rollers 55 respectively engaged in the cam slots 51 and 52.

An hydraulic cylinder 60 is mounted between the mast legs 40*a* and an upstaning bracket 34 provided on the sub-frame 30. Cylinder 60 is thus effective to move the mast 40 in a vertical plane and the specific path of movement of the mast 40 and its vertical position will be defined by the configuration of the arcuate cam slots 51 and 52.

Lastly, a levelling control mechanism 70 is mounted on the side of mast legs 40*a* and is effective to generate an hydraulic signal whenever the posiion of the mast 40 departs from the true vertical. Devices of this type are well known in the art and will not be described in detail. In any event, whenever the mast 40 departs from a true vertical position, the levelling mechanism 70 generates an hydraulic signal to actuate the position control cylinder 60 to restore the mast 40 to a true vertical position. This necessarily means that the mast legs 40*a* are moved along the cam slots 51 and 52. These cam slots are proportioned so as to effect a correction in the effective height of the mast 40 which is a trigonometric function of the angle of the digging frame axis relative to the true vertical.

The details for calculating this trigonometric correction are set forth in my above referred to co-pending application Ser. No. 628,095 and will not be repeated herein. Referring to FIG. 3, if $X_1$ is the distance between the lower pivot pin 53 of mast 40 and the axis of the rear sprocket 14*a*, then the necessary correction to $X_1$ to maintain the bottom of the mast 40, hence the sighting bar 41, at the same distance relative to the bottom of the trench as the digging angle A varie, is defined by the following equation:

$$X_1 = X_2 \cos A + X_3 \sin A$$

where $A$ is the digging frame angle, $X_2$ is the perpendicular spacing between the axis of the mast pivot roller 53 and the digging frame axis 11*a*, and $X_3$ is the spacing between the axis of the rear sprocket 14*a* and the line $X_2$. The cam slots 51 and 52 are therefore designed to impart this effective height adjustment of the mast 40 as a function of any changes in the digging frame angle A. Thus the operator is assured that the sighting bar 41 carried by the top of mast 40 is always the same distance from the bottom of the trench being dug.

In the operation of the mechanism heretofore described, a plurality of stationary sighting bars 80 (FIG. 1) are positioned along the path of the trench to be dug. The effective height of these sighting bars are adjusted by conventional surveying techniques to define a reference plane to which the depth of the trench being dug is to be exactly parallel. The operator forces the digging frame 11 into the ground by appropriate actuation of cylinders 13*a* and 13*b* until the desired trench depth is secured as determined by an actual physical measurement. At that point, the operator adjusts his sighting bar 41 vertically on the mast 40 to align same with the nearest sighting bar 80 which will generally be positioned at a point behind the beginning of the trench to be dug. The operator's sighting bar 41 is then locked into the visually aligned position with the reference sighting bar 80 by actuation of the locking screw 42. The vehicle 1 is then operated to move along the desired path of the trench to be dug. The operator continuously observes the position of the sighting bar 41 relative to the nearest stationary reference bar 80. If the operator visually detects any deviation of his sighting bar from the reference plane defined by the stationary sighting bars, he manually operates the actuating cylinders 13*a* and 13*b* to bring the operator's sighting bar 41 back into visual alignment with the stationary reference sighting bars. As has already been described, the resulting change in the digging angle A will tend to tilt the upstanding mast 40 from the true vertical position and this will cause the levelling mechanism 70 to actuate cylinder 60 to restore the mast 40 to its true vertical position and, at the same time, effect a correction in the effective height of the mast 40 which is a trigonometric function of the change in digging frame angle A as expressed by the equation above.

Modification of this invention will be apparent to those skilled in the art and it is intended to include all such modifications within the scope of the appended claims.

I claim:

1. In a trencher of the type having an elongated digging frame having one end thereof pivotally mounted on a vehicle for movement in a vertical plane parallel to the path of movement of the vehicle, said digging frame having two spaced sprockets traversed by an endless chain carrying a plurality of spaced digging scoops, means on the vehicle for driving the forward sprocket and power means on the vehicle for varying the pivotal angle of said digging frame relative to the horizontal, thereby determining the depth of the trench being dug by said blades, the improvement comprising:

1. stationary sighting bar means disposed along the path of travel of the vehicle, said means defining a visual plane of known height relative to the desired depth of the trench to be dug;
2. an upstanding mast having its bottom end pivotally mounted on said digging frame adjacent the free end thereof for movement in a vertical plane;
3. means for maintaining said mast in a true vertical position irrespective of the angular position of said digging frame, said last mentioned means concurrently effecting a change in the effective height of said mast as a trigonometric function of the angle of said digging frame relative to the true horizontal and,
4. a horizontal sighting bar vertically ajustably mounted on said mast to permit said bar to be visually aligned with said stationary sighting bar means when said digging frame is initially forced into the ground to the desired starting depth for the trench to be dug.

2. The combination defined in claim 1 wherein said trigonometric function is equal to $X_2 \cos A + X_3 \sin A$, where A is the angle of the digging frame relative to the horizontal, $X_2$ is the perpendicular spacing between the mast pivot axis and the longitudinal axis of the digging frame, and $X_3$ is the spacing between the axis of the rear digging frame sprocket and the line defined by $X_2$.

3. The combination defined in claim 1 wherein said mast position maintaining means comprises a vertical plate secured to said digging frame, said plate having a pair of cam slots therein respectively pivotally receiving a pair of vertically spaced horizontal pins traversing said mast.

4. In a trencher of the type having an elongated digging frame having one end thereof pivotally mounted on a vehicle for movement in a vertical plane parallel to the path of movement of the vehicle, said digging frame having two spaced sprockets traversed by an endless chain carrying a plurality of spaced digging scoops, means on the vehicle for driving the forward sprocket and power means on the vehicle for varying the pivotal angle of said digging frame relative to the horizontal, thereby determining the depth of the trench being dug by said blades, the improvement comprising:

1. stationary sighting bar means disposed along the path of travel of the vehicle, said means defining a visual plane of known height relative to the desired depth of he trench to be dug;
2. s sub-frame mounted on said digging frame in cantilevered over-lying relationship thereto, the free end of said sub-frame over-lying the position of said rear sprocket;
3. an upstanding plate secured to the free end of said sub-frame;
4. an upstanding mast having a bifurcated bottom end portion straddling said plate and supported thereby for both limited pivotal movement in a vertical plane and concurrent vertical movement;
5. cam means on said plate for varying the effective height of said mast as a trigonometric function of said pivotal angle of said digging frame;
6. a horizontal sighting bar vertically adjustably mounted on the top of said mast to permit manual alignment of said sighting bar with said stationary sighting bar means when said digging frame is initially positioned at the desired trench depth, and
7. means for maintaining said mast in a true vertical position irrespective of the angular position of the digging frame.

5. The combination defined in claim 4 wherein said cam means comprises two vertically spaced slots in said plate respectively trasversed by two verticlly spaced horizontal pins passing through the bifurcated bottom portions of said mast.

* * * * *